US012800266B2

(12) United States Patent
Griggs et al.

(10) Patent No.: US 12,800,266 B2
(45) Date of Patent: Nov. 17, 2026

(54) ARCHERY BOW SIGHT ILLUMINATION DEVICE

(71) Applicant: ACU Archery USA L.L.C., Clay City, KY (US)

(72) Inventors: Eric J. Griggs, Stanton, KY (US); Braden R. Gellenthien, Winchester, KY (US); Aaron L. Adams, Richmond, KY (US); Eldar J. Sarmento, Atascadero, CA (US)

(73) Assignee: GAS Outdoors, LLC, Clay City, KY (US)

( * ) Notice: Subject to any disclaimer, the term of this patent is extended or adjusted under 35 U.S.C. 154(b) by 209 days.

(21) Appl. No.: 18/936,473

(22) Filed: Nov. 4, 2024

(65) Prior Publication Data

US 2026/0126270 A1 May 7, 2026

(51) Int. Cl.
*F41G 1/467* (2006.01)
*F41G 1/34* (2006.01)

(52) U.S. Cl.
CPC ..... *F41G 1/345* (2013.01); *F41G 1/467* (2013.01)

(58) Field of Classification Search
CPC ..... F41G 1/345; F41G 1/467
See application file for complete search history.

(56) References Cited

U.S. PATENT DOCUMENTS

| | | | | |
|---|---|---|---|---|
| 5,394,615 | A * | 3/1995 | Hoppe | F41G 1/467 124/87 |
| 7,337,773 | B2 * | 3/2008 | Simo | F41B 5/143 124/44.5 |
| 7,895,996 | B2 * | 3/2011 | Grove | F41G 1/467 124/87 |
| 7,988,314 | B2 * | 8/2011 | Nichols | F41G 1/345 362/800 |
| 11,415,390 | B2 * | 8/2022 | Chang | F21V 21/0832 |
| 11,846,492 | B2 * | 12/2023 | Chang | F41G 1/345 |
| 12,135,189 | B2 * | 11/2024 | Jones | F41B 5/14 |
| 12,264,894 | B2 * | 4/2025 | Overfelt | F41G 1/38 |
| 2009/0090342 | A1 * | 4/2009 | Freitag | F21V 33/008 124/32 |
| 2011/0036337 | A1 * | 2/2011 | Freitag | F41B 5/1469 124/32 |
| 2026/0126270 | A1 * | 5/2026 | Griggs | F41G 1/345 |

* cited by examiner

*Primary Examiner* — Yaritza Guadalupe-Mccall
(74) *Attorney, Agent, or Firm* — Warner Norcross + Judd LLP

(57) ABSTRACT

An archery bow sight light can include a shaft defining a light bore extending from a housing defining a primary compartment, a battery access opening laterally offset and distal from the light bore, and a coin battery tray slidably disposed in the primary compartment, and a light source that can illuminate sight elements of a bow sight. The shaft can thread into a threaded hole of the sight for securement thereto. The tray can be sized to receive therein a coin battery laying in a plane to which the bore and its axis are orthogonal. A controller in the housing can be in communication with a movement sensor and configured to automatically power the light source when the bow sight is moved. The controller can turn off the light source after a predetermined amount of time passes after the light source is powered to preserve battery life.

20 Claims, 6 Drawing Sheets

ARCHERY BOW SIGHT ILLUMINATION DEVICE

BACKGROUND OF THE INVENTION

The present invention relates to archery, and more particularly to an archery bow sight light.

Most conventional archery bows, such as compound bows, are set up with an archery bow sight to assist in aiming the bow and shooting an arrow at a target or game. An archery bow sight typically includes a housing and one or more sight pins including a fiber optic filament that the user will overlap with a target and use to aim the bow. To enhance the contrast between the fiber optic filaments in ambient lighting, or to enhance the visibility of the filaments in low light conditions, some bow sights are outfitted with a bow sight light to illuminate the fiber optic filaments. Conventional bow sight lights include an LED, a switch and a mount to install the light to a bow sight. Due to the size of a bow sight light, only small hearing aid type batteries are typically used to power the light. To conserve the life of these small batteries, archers often manually turn on the bow sight light when shooting, and immediately manually turn off the light when the shooting activity ceases.

Problems arise with conventional bow sight lights. For example, if the archer forgets to turn off the light, the battery can drain. The next time the user needs to use the light, it will not power on, potentially leaving the user with an inoperative light for use in the desired shooting activity. The user many times will also need to replace the battery. Further, manually turning a light on and off during a competitive archery event can be distracting and add unnecessary anxiety or pressure. The same is true when manually turning a light on during a hunting activity in low light conditions. The sight light may be difficult to operate well in such conditions, and operating it manually can add extra movement, which may spook the intended game.

Accordingly, there remains room for improvement in the field of bow sight lights, their operation and function.

SUMMARY OF THE INVENTION

An archery bow sight light can include a shaft defining a light bore extending from a housing defining a primary compartment, a battery access opening laterally offset and distal from the light bore, a coin battery tray moveably disposed in the primary compartment, and a light source that can illuminate sight elements of a bow sight.

In one embodiment, the shaft can thread into a threaded hole of the sight for securement thereto. The housing can be supported or suspended from the bow sight via the shaft in the hole with the housing being placed in a low profile adjacent the bow sight. The light bore can extend toward one or more sight elements, for example, fiber optic filaments that form sight indicia within the bow sight. The light source can project light through the bore to the sight elements.

In another embodiment, the tray can be sized to receive therein a coin battery laying in a plane to which the bore and its axis are orthogonal. The tray can be aligned with a battery access opening and can be slidable toward and/or through the opening to access a coin battery stored in the tray. The tray can slide laterally and transverse to the axis to remove the battery.

In still another embodiment, a battery tray receiver can be inside the housing and can define a tray compartment configured to slidably receive the battery tray. The battery can be installed in the battery tray. The battery tray receiver can include a terminal, for example in the form of a resilient arm or other contact, that contacts the battery installed in the tray to provide power to the light source.

In yet another embodiment, a controller can be disposed in the housing. The controller can be on a circuit board. The light source can be a light, as an LED, OLED, SMD or other type of light or light arrays, which can be disposed on the circuit board as well.

In even another embodiment, the controller can be in communication with a movement sensor. The movement sensor can detect or sense movement of the bow sight light, the bow sight and/or the bow to which the light is attached. The movement sensor can send a signal to or otherwise communicate with the controller based on the sensed or detected movement.

In a further embodiment, the controller can be configured to automatically power the light source when the bow sight is moved, based on input from the movement sensor. Thus, the bow sight light can illuminate with the light source the sight elements associated with the bow sight to which the bow sight light is joined. This can occur when a user picks up or moves the archery bow to which the bow sight light is secured.

In still a further embodiment, the controller can turn off the light source in an inactivity sleep mode, after a first predetermined amount of time passes after the light source is powered to preserve battery life. For example, the controller can be coupled to a timer control that measures or monitors passage of time. The timer control can monitor the passage of 1 minute, 2 minutes, 3 minutes, 4 minutes, 5 minutes or other increments of time and provide a signal to the controller or vice versa, at which passage of time, the controller can turn off the light source and/or terminate transfer of electricity from the battery to the light source. The controller can utilize input from the timer and turn off the light source in the inactivity sleep mode to conserve battery life, for example, when the bow to which the sight is secured is not being used to shoot at a target, but before the bow is stored or put away for a long period of inactivity.

In yet a further embodiment, the controller can turn off the light source in a deep sleep mode, after a second predetermined amount of time passes to preserve battery life. For example, the controller can be coupled to the timer control that measures or monitors passage of time. The timer control can monitor the passage of 1 hour, 2 hours, 3 hours, 4 hours, 5 hours or other increments of time and provide a signal to the controller or vice versa, at which passage of time, the controller can depower then turn off the entire system. The controller can utilize input from the timer and turn off the entire system in the deep sleep mode to further conserve battery life, for example, when the bow to which the sight is secured is being stored for a long period of time and fully not in use, nor intended to be used for many hours, days or weeks.

In a further embodiment, the controller can be coupled to a user input or user interface. The user interface can be disposed on a distal wall of the housing, opposite a proximal wall, or along some other wall of the housing. The user interface can include a pushbutton or other manual input that can be activated and/or engaged by a user, which can communicate user input to the controller to change settings of the system. For example, the user can change the first predetermined time, the second predetermined time, brightness of a display and other parameters.

In still a further embodiment, the user interface can be disposed adjacent a display that can display alphanumeric or other output to a user operating the bow sight light. The display can be visible to a user and can output information related to the operation of the light, the controller, the timer control and other things.

The current embodiments provide a compact, easy to use and user-friendly bow sight light. Where it includes a threaded shaft, the bow sight light can be easily threaded into a variety of bow sights to be in place to illuminate sight elements and enable the user to readily see parts of those elements in low light or other light conditions. Where included, the housing can be very low profile, yet can house a removeable coin battery tray. Where included, the coin battery tray can be in a tray receiver and locked or closed in the housing with a closure, which can avoid unintended or unauthorized tampering or access to the battery which can promote battery safety and securement. The action and movement of the tray also can be a sliding movement transverse or non-axial relative to the longitudinal axis, which can be counterintuitive, thus further promoting safety and reducing the likelihood of unauthorized access, for example by young children. Where included, the controller can control the light source and illuminate it when the bow sight and bow is moved, based on input from the movement sensor. Thus, the controller automatically can light up the light source when the bow to which the bow sight light is attached is moved, so a user need not manually turn on or actuate the system to illuminate the light, thus saving time and reducing extra movement of the user. Where included, the controller also can turn off the light source and cease illumination thereby after a first predetermined amount of time in an inactivity sleep mode. The light source can remain off when the bow is not moving for example, in a ready to shoot orientation, which can conserve the battery life by many, many hours, in some cases allowing up to 100 hours of operating battery life. Where included, the controller also can put the system in a deep sleep mode entirely, thereby further extending battery life after a second predetermined amount of time passes after inactivity, for example when the bow sight light is in storage with the bow to which it is attached. This can again preserve battery life sometimes allowing a single battery to operate the bow sight light for up to or over 1000 hours.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

A current embodiment of the bow sight light is shown in FIGS. 1-5 and generally designated 10. The archery bow sight light 10 is shown installed on a bow sight 100, which is further mounted to an archery bow 105 and in particular a riser of the archery bow. The bow sight light 10 can be used with a variety of archery bows, including compound archery bows, recurves, long bows, crossbows, and other projectile shooting devices that have a sighting or other viewing system. Further, the bow sight 100 described here can come in a variety of different configurations and may include more or fewer components than that shown.

Figure 2:
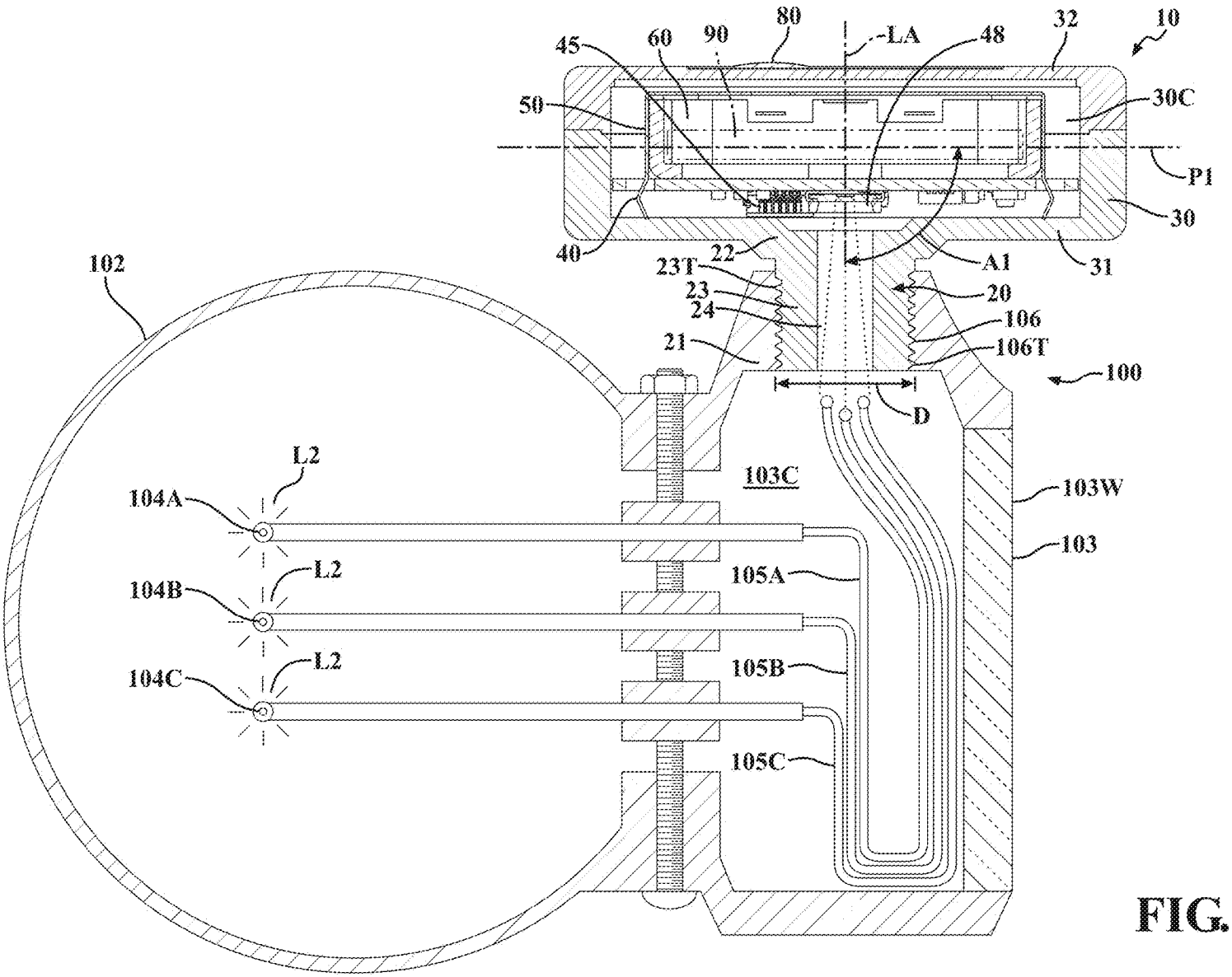
FIG. 2 is a section view of the bow sight light and a bow sight to which it is attached.

The archery sight 100 can include a mounting arm 101 that is fastened to the riser 105 and extends forwardly to an armature optionally including a windage adjuster 101W and an elevation adjuster 101E. The bow sight 100 can further include a sight housing 102 that is joined with a base 103. The base 103 can include a closed or open recess, compartment or cavity 103C as shown in FIG. 2. Multiple sight elements 104A, 104B and 104C can be movably mounted in the sight housing 102 and can be adjusted via the elevation adjuster 101E and/or windage adjuster 101W. Each of the sight elements 104A, 104B and 104C can include a fiber optic filament, light pipe, phosphorous element, or other light transmissive filament or element, referred to herein interchangeably as a light fiber or fiber optic element. The light fibers 105A, 105B, 105C can each be associated with the respective sight elements 104A, 104B and 104C. It is to be noted that although shown as having three sight elements, the bow sight 100 can include fewer or more sight elements.

The light fibers 105A, 105B and 105C can extend into the compartment 103C. The compartment 103C can be opaque and/or can include a window 103W that can be transparent and/or translucent to allow light to enter into the compartment 103C. The light elements 105A, 105B and 105C can extend past or generally near an aperture or hole 106 of the base 103. In some cases, the ends of the light fibers can be aligned with or extend toward or adjacent a longitudinal axis LA of a connector 20 of the bow sight light 10 so that those ends optionally can be illuminated by a light source 48 of the bow sight light 10 as described below. In other cases, the light fibers can simply extend through or past or near the longitudinal axis LA or generally within illumination L projected by the light source as described below.

Figure 1:
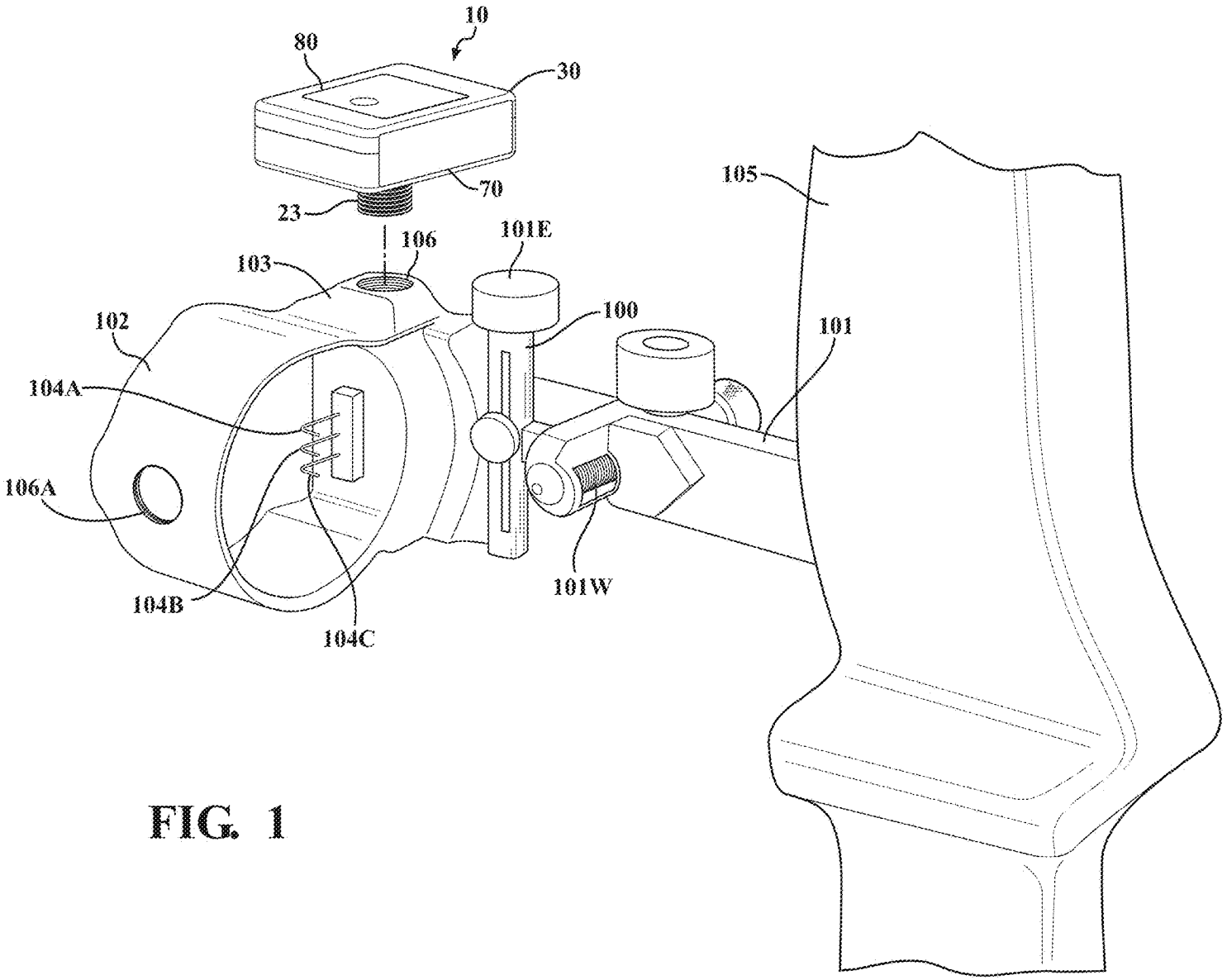
FIG. 1 is a perspective view of the bow sight light mounted on a bow sight over a light box housing fiber optics of one or more sight elements.

The hole 106 can be defined in the base 103 and can be configured to provide attachment of the bow sight light 10 to the sight 100. Alternatively, the hole can be defined in another part of the sight 100, such as the sight housing (above, below or laterally disposed from the sight elements), the bracket or in some other position. One exemplary position for an alternative hole 106A to mount the bow sight light 10 is shown in FIG. 1 on the outer portion of the housing. The hole 106 (or 106A) as shown can include threads 106T. In some cases the diameter D1 of the hole 106 can be sized ¼"-28, ⅜"-32, 7⁄16"-20, 6-32, 8-32, 10-32, 10-24 or other sizes. The bow sight light 10 can include the connector 20 which can be sized to correspond to the aforementioned sizes of the hole and can optionally thread into corresponding threads 106T of the hole 106. In particular the bow sight light 10 can include the connector 20 which can comprise a shaft to 23 having a proximal or first end 21 and a distal or second end 22. The exterior of the shaft 23 can include threads 23T that can mate with the corresponding threads 106T of the hole 106. The connector 20 and in particular the shaft 23 can define a light bore 24 that extends through the shaft from the proximal end 21 to the distal end 22. The bore 24 can be of a generally cylindrical shape, or that shape can be modified to be polygonal or an irregular shape. The bore 24 can be centered on the longitudinal axis LA of the bow sight light 10.

Optionally, the longitudinal axis LA can extend centrally through the light bore. The bore can extend toward and/or be placed adjacent or near the compartment 103C of the base 103. When the bow sight light 10 is installed relative to the bow sight 100, the bore 24 can project or point toward and/or be aligned with or overlap a portion of the light fibers 105A, 105B, 105C, so that light or illumination L projected through the light bore will also illuminate those light fibers as shown in FIG. 2.

With further reference to FIGS. 1-4 the shaft 23 and generally the connector 20 can be joined with a housing 30. The housing 30 can be similar to a container or box to house certain components of the bow sight light 10, for example, a circuit board 40, a tray receiver 50, a tray 60 and a battery 90 disposed in the tray 60 as described below. The housing can define a primary compartment 30C that is oriented in a plane P1. Generally, the plane P1 can extend through the compartment 30C. Multiple other components of the housing, circuit board 40, tray receiver 50 tray 60, and battery 90 can be substantially parallel to the plane P1. This plane P1 can also form a reference plane. The longitudinal axis LA of the bow sight light 10, when centrally located in the light bore 24 and/or the shaft 23 can be orthogonal to the plane P1. In other cases, the longitudinal axis LA can be perpendicular to and/or intersect the plane P1. In some cases, the longitudinal axis LA can be perpendicular to the plane P1. Optionally, with this configuration, the housing and the components therein, with the shaft 23 projecting therefrom as shown for example in FIGS. 1-4 can take on a mushroom configuration, with the shaft 23 forming a stem in the housing 30 forming the cap of a mushroom. Of course, the bow sight light 10 can come in other configurations and layouts.

The housing 30 can include a proximal wall 31 and a distal wall 32. The proximal wall 31 can be joined with the second end 22 of the shaft. The distal wall 32 can be distal from the shaft 23. The longitudinal axis LA can be orthogonal or generally can intersect or can be transverse to each of the proximal wall 31 and/or the distal wall 32. The housing 30 can be constructed to include one or more side walls 33. The side walls 33 can project upwardly from the proximal wall 31 toward the distal wall 32. In some cases, these side walls can be perpendicular to the proximal wall 31 and distal wall 32. The sidewall 33 also can be segmented into the first side wall 33A, a second side wall 33B and a third side wall 33C. The side walls 33A and 33B can be separate and parallel to one another and can bound at least a portion of the primary compartment 30C. Each of these side walls can extend up generally perpendicular to the proximal wall as shown or at other orientations. The distal wall 32 also can be joined with and transition to another set of side walls 34A, 34B and 34C. The side walls can generally align with and form extensions of the other side walls 33A, 33B, 33C.

Figure 4:
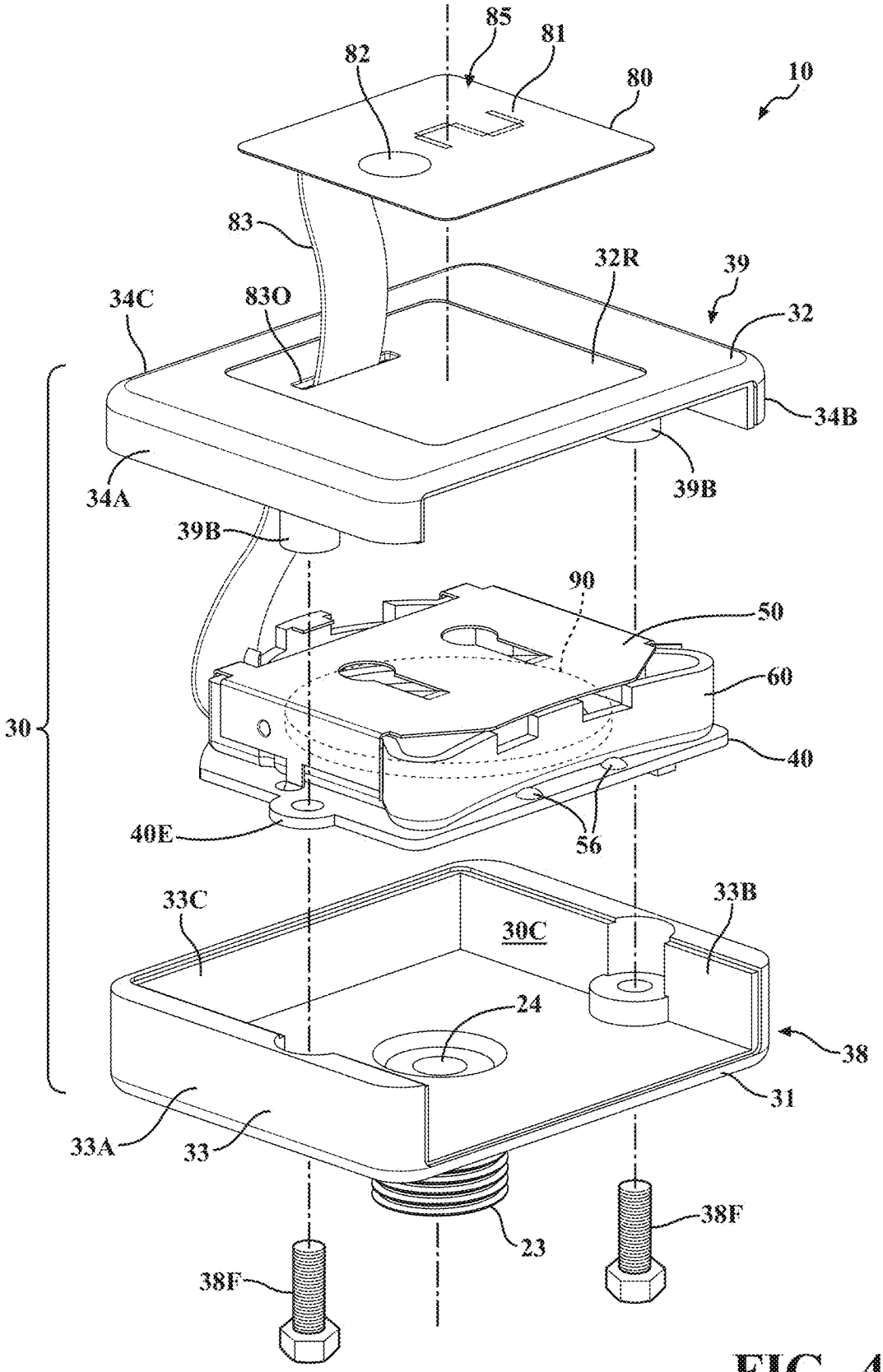
FIG. 4 is a vertically exploded upper view of the bow sight light.

Optionally, as shown in FIG. 4, the distal wall 32 and side walls 34A, 34B and 34C can form a top or cover 39 of the primary compartment 30C, closing off the upper portion of the housing 30. The cover 39 can be joined with a base 38 which optionally can be formed from the proximal wall 31, the side walls 33A, 33B, 33C and the shaft 23. The cover 39 can be secured to the base 38 via one or more fasteners 38F which can be received in bosses or other threaded portions 39B associated with the cover 39. The fasteners 38F can be tightened to secure the cover 39 to the base 38. In some cases, there can be a seal or waterproofing at the interface of the cover and the base.

Figure 3:
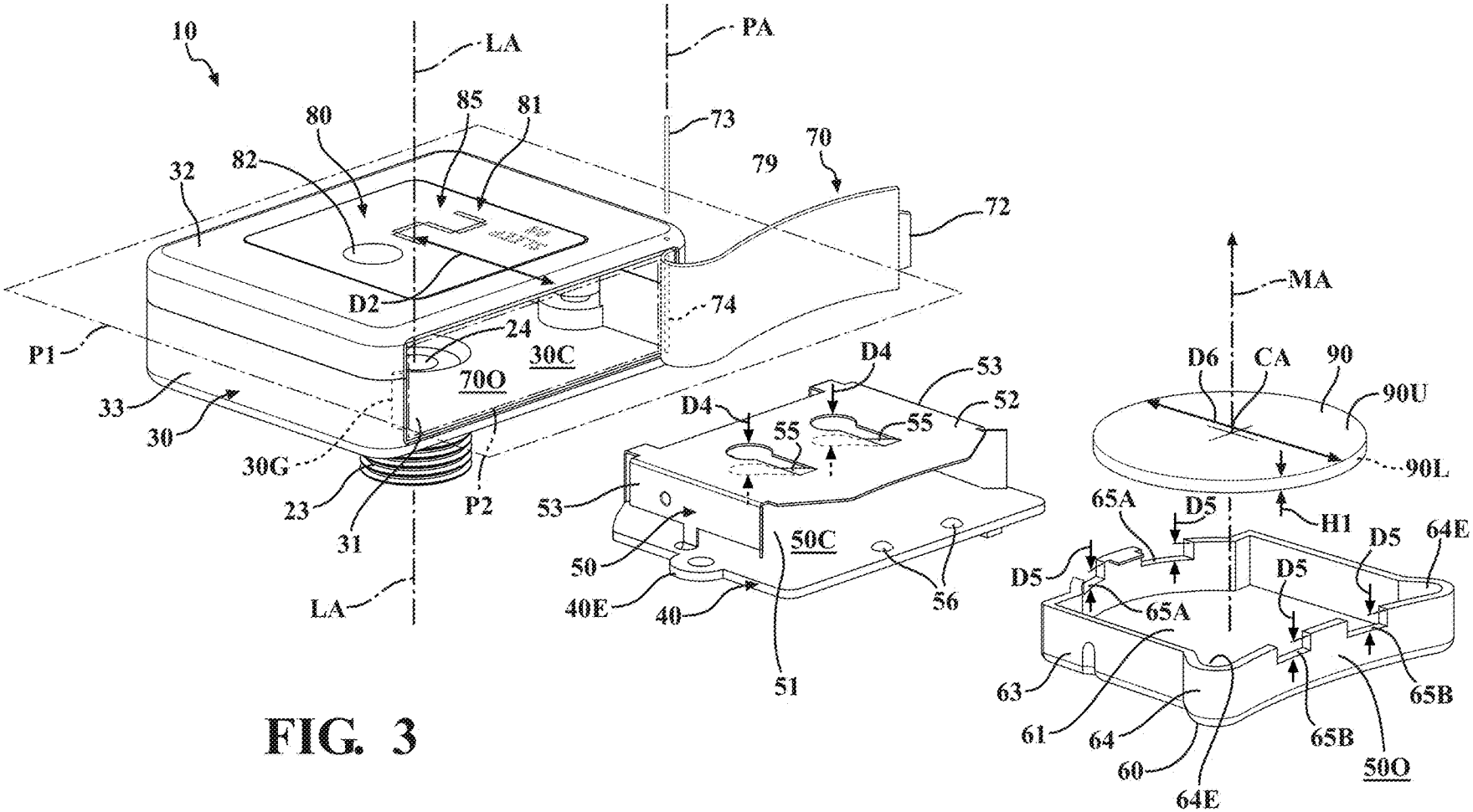
FIG. 3 is an exploded view of the bow sight light.

As shown in FIGS. 3 and 4, the housing 30 can include a battery access opening 70O. This battery access opening 70O can form an access to the primary compartment 30C. It can be bounded by the side walls, the proximal wall and the distal wall of the housing. Optionally, the battery access opening 70O can be closed off via a closure 70. The closure 70 can be movably joined with a housing 30 to provide access to the primary compartment 30C. In some cases, the closure 70 can be a door or panel, optionally formed of a polymer, metal, rubber, silicone or other material. It can swing open as shown in FIG. 3 and can be closed as shown FIG. 1 to close off the primary compartment 70O. As shown, the closure 70 can be in the form of a flexible or moveable elastomeric flap that includes a tab 72 at one end. That tab can interfit within a groove or recess 30G associated with the housing 30 to secure the closure 70 over the battery access opening 70O. The closure 70 can include a pin 73 that extends through a corresponding hole 74 at one end opposite from the tab 72 such that the closure or flap panel 70 can rotate or move about that pin or hinge. Of course in other applications, the closure 70 can be molded, secured or otherwise attached to the housing in a variety of other manners.

The closure 70 and the battery access opening 70O are shown in FIG. 3 as being latterly offset the distance D2 from the longitudinal axis. The opening 70O and the closure 70 are thus not aligned with the longitudinal axis, nor intersected by that longitudinal axis LA. The distance D2 optionally can be greater than 2 mm, greater than 5 mm, greater than 10 mm, greater than 20 mm, offset from the longitudinal axis LA. The opening 70O to access the battery 90 can also lay in a plane P2 that is perpendicular or transverse to the plane P1 which itself is situated to be orthogonal to the longitudinal axis LA. The battery access opening 70O can be offset from the light bore 24 such that if projected beyond the proximal wall 31, the light bore does not intersect the battery access opening 70O, nor the closure 70. The plane P2 of the opening also is laterally offset from that bore and would not be intersected by that bore if projected beyond the proximal wall 31.

The bow sight light in FIGS. 1-5 can include a battery tray receiver 50. This battery tray receiver can be disposed in the housing in the primary compartment generally between the distal wall 32 and the proximal wall 31. The battery tray receiver can be aligned with the battery access opening 70O.

The battery tray receiver can itself include a tray opening 50O which is aligned with the battery access opening 70O. The tray opening 50O can be defined between a receiver distal wall 52 and a receiver proximal wall 51. The proximal wall 51 of the receiver can be disposed adjacent and electrically coupled to a circuit board 40 as described below. The distal wall 52 can lay over the battery 90 when the battery tray 60 is installed in the battery tray receiver 50. The distal wall and/or the proximal wall, or other side walls 53 of the receiver 50 can include one or more arms, legs, or prongs 55, referred to generally as arms. These arms 55 can form terminal contacts and can be resilient. These arms 55 can contact an upper 90U or lower 90L surface of the battery 90 when the battery is in the battery tray 60 or generally inside the receiver 50. Optionally, in some applications, where the tray 60 is absent, the battery tray receiver 50 can form a battery tray or receiver itself such that the battery 90 can be disposed directly in the receiver 50, without another tray 60 and can contact the respective arms 55 to provide an electrical coupling to the circuit board 40 as described below.

The arms 55 can project downwardly into the tray compartment 50C. In some cases, the arms can project down the distance D4 into the battery tray receiver compartment 50C. In such cases the tray 60 itself can be outfitted with one or more corresponding notches 65A and/or 65B along the respective wall 63 of the battery tray 60. These notches can allow the respective wall 63 to clear the arms when the tray is inserted into the receiver compartment 50C. These notches optionally can be a depth D5, which is equal to or greater than the distance D4 that the arms extend downward from the wall 52 of the battery tray receiver 50. Again, this can be so that the arms clear the walls of the battery tray 60. Of course, in other applications the walls of the tray 60 can be shorter so that clearance of the arms 55 is not an issue in which case the sidewalls are short enough to clear those prongs.

The battery tray receiver 50 shown in FIGS. 3 and 4 can be configured such that it fits within the primary compartment with the battery tray receiver opening 50O aligned with the battery access opening 70O. In the closed mode of the closure 70, the closure can extend over the battery access opening 70O as well as the battery tray receiver opening 50O. As mentioned above, the closure 70 can be in the form of a panel that is movably or hingedly joined with the housing 30. It can be configured to swing over the battery access opening and the battery tray receiver opening in the closed mode. Optionally, the closure 70 can be opened as shown in FIG. 3 to expose the battery access opening 70O and likewise the tray receiver opening 50O when the receiver tray is inside the housing 30. The battery tray receiver or circuit board can include one or more retainers 56. These retainers 56 can be simple projections or bumps that can interface with a wall of the battery tray 60 when the battery tray is fully installed in the battery tray receiver 50. Optionally, other types of locking mechanisms or securement mechanisms can be included adjacent the battery tray to retain the battery tray further in the primary compartment 30C, in addition to or alternatively to the closure 70.

As mentioned above, and shown in FIGS. 2-4, the battery 90 can be disposed in the battery tray 60, disposed in the battery tray receiver 50, which itself is disposed in the primary compartment 30C of the housing 30. The battery shown in the current embodiment can be a coin battery, which can have a diameter D6 and a height H1. Optionally, the coin battery can include a diameter D6 of 10 mm to 30 mm, inclusive, 10 mm, 16 mm, 20 mm or 30 mm. The coin battery can have a height H1 of 1 mm to 8 mm, inclusive, 2 mm, 3 mm, 4 mm, 5 mm, 6 mm, 7 mm or 8 mm. The coin battery can have a diameter to height ratio of at least 10:1, at least 8:1, at least 5:1; at least 3:1 or other ratios. Optionally, the battery can be more flat than it is thick. Some suitable coin batteries can be lithium batteries designated CR2016, CR2025, CR2032 or CR2450. Of course, other batteries can be used.

The coin battery 90 can be alkaline, lithium, silver oxide, or other chemical makeups. The coin battery can provide a nominal voltage of 1.5 volts or 3 volts, suitable for the bow sight light 10. The coin battery can have varying capacities, for example about 220-240 milliamp hours, about 150-170 milliamp hours, about 90-100 milliamp hours, or about 500-600 milliamp hours. Optionally, in some embodiments, the battery can be a rechargeable battery, such as a lithium-ion battery, a nickel-cadmium battery, a nickel-metal hydride battery, a lead acid battery and the like, in which case the housing can be outfitted with a USB-C charging port or other connection to charge the battery. Further, where the battery is rechargeable, the battery tray and tray receiver can be deleted from the construction, with the rechargeable battery electrically coupled to the controller and/or the circuit board.

The coin battery 90 can fit within the battery tray 60 which itself can be disposed in the battery tray receiver 50 which can be disposed within the housing 30 and the primary compartment 30C thereof. When installed, the battery can be secured via the closure 70 disposed over the opening 70O, receiver opening 50O and the compartment 30C. As shown in FIGS. 2 and 3, the battery 90 can lay within the reference plane P1. The battery can be disposed in the plane P1 with the longitudinal axis LA orthogonal to the plane P1 and the battery 90. The battery 90 and battery tray 60 can be removable from the housing 30 via the battery access opening 70O. To remove the battery, a user can open the closure 70 by disengaging the closure elements 72 and 30G, which again can be in the form of a tab and groove or some other connector. The closure 70 can be swung, pivoted and/or moved to the open position shown in FIG. 3, generally moving away from the opening 70O. Optionally, the closure can at least partially pivot about a pivot axis PA, which optionally can be parallel to and distal from that longitudinal axis LA. Of course, in so pivoting, where the door or panel 70 is made from a flexible material, it can dynamically flex in moving to the open position or open mode shown in FIG. 3. With the closure open and the battery access opening 70O in the open mode, the tray 60 can be grasped and slid or moved outward within or aligned with the plane P1 to which the longitudinal axis LA is orthogonal. In so doing, the arms 55 of the tray receiver 50 can disengage the battery 90 and break contact therewith such that the components of control system 49 described below are no longer powered by the battery 90. The arms 55 can move through the notches 65A as the tray is removed. The battery 90 can be accessed and pulled upward and outward, generally along a line of motion MA that is orthogonal to the base plate 61 of the tray. In so doing, the battery 90 might not be moved along a line of motion MA to remove the battery from the housing along the longitudinal axis. Indeed, as shown, the might of motion MA can be distal and removed from the housing entirely as shown in FIG. 3. Further, the battery 90 can be configured such that its center CA is moved laterally away from the longitudinal axis rather than axially along the longitudinal axis for removal of the battery from the housing 30. Moreover, the battery 90 and its center CA can be displaced laterally away from the light board 24 optionally sliding or moving across or relative to the proximal wall 31 which can be in the form of a plate as shown with the light bore projecting through the plate.

With further reference to FIGS. 3 and 4, the battery tray 60 can include projections or ears 64E that can be grasped or engaged by a user to remove the tray 60 from the housing 30. These ears can include openings in which a user can project a portion of a digit or a small tool to engage the tray and pull the battery tray 60 out from the housing and laterally away from the longitudinal axis and light bore. As mentioned above, the tray 60 can include a bottom 61 and a lateral side wall 63 that extends upwardly around the perimeter of the bottom. The sidewall can define the notches 65A and 65B that can accommodate the one or more arms or terminals 55 so that the arms can be brought into contact with the battery to power the control system on the optional circuit board 40. The tray 60 also can be held in the tray receiver 50 via the retainers 56 or some other mechanism.

As mentioned above, the bow sight light 10 can include a display 80. This display can include a manual input 82, which can be a touch pad, touch screen, button or other input that can be manually engaged by a user. Depending on the manual input by a user, a signal can be sent via a flex cable 83 to the controller 45 which again optionally can be disposed on a circuit board 40 or otherwise disposed in the housing 30 as described below. The display portion 85 of the display 80 can display alphanumeric characters 81 which can represent the brightness, battery life, time on, time off, or other settings or characteristics of the bow sight light, depending on the application. The display portion 85 can include a liquid crystal display (LCD), an organic light emitting diode (OLED) display, a mini-LED, a Micro-LED or other display depending on the application. Further, in operation, the manual input 82 can alter what is displayed on the display portion 85 of the display to provide the user with feedback and controlling the bow sight light.

The display can be set in a recess 32R that is defined by the housing 30. Alternatively, the display can be simply adhered, fastened or otherwise mounted to the bousing in a particular orientation. As shown, the display is intersected by the longitudinal axis LA in FIG. 4. Where the display 80 faces upward, this can ensure that any displayed alphanumeric characters on the display portion 83 project associated illumination upward, rather than back toward the user or downward toward game if the user is a bow hunter hunting from an elevated stand. This can minimize the distraction caused by the display when using the sight elements of the bow sight 100. Optionally, the flex cord or cable 83 can extend from the display 80 to the circuit board 40. In so doing, the flex cord 83 can extend through an opening 83O defined by the housing 30 and optionally by the distal wall 32 of the housing into the primary compartment 30C. In other applications, the display 80 can be connected to the circuit board 40 in other manners and in some cases may even be fixed or hard mounted to that board 40.

Figure 5:
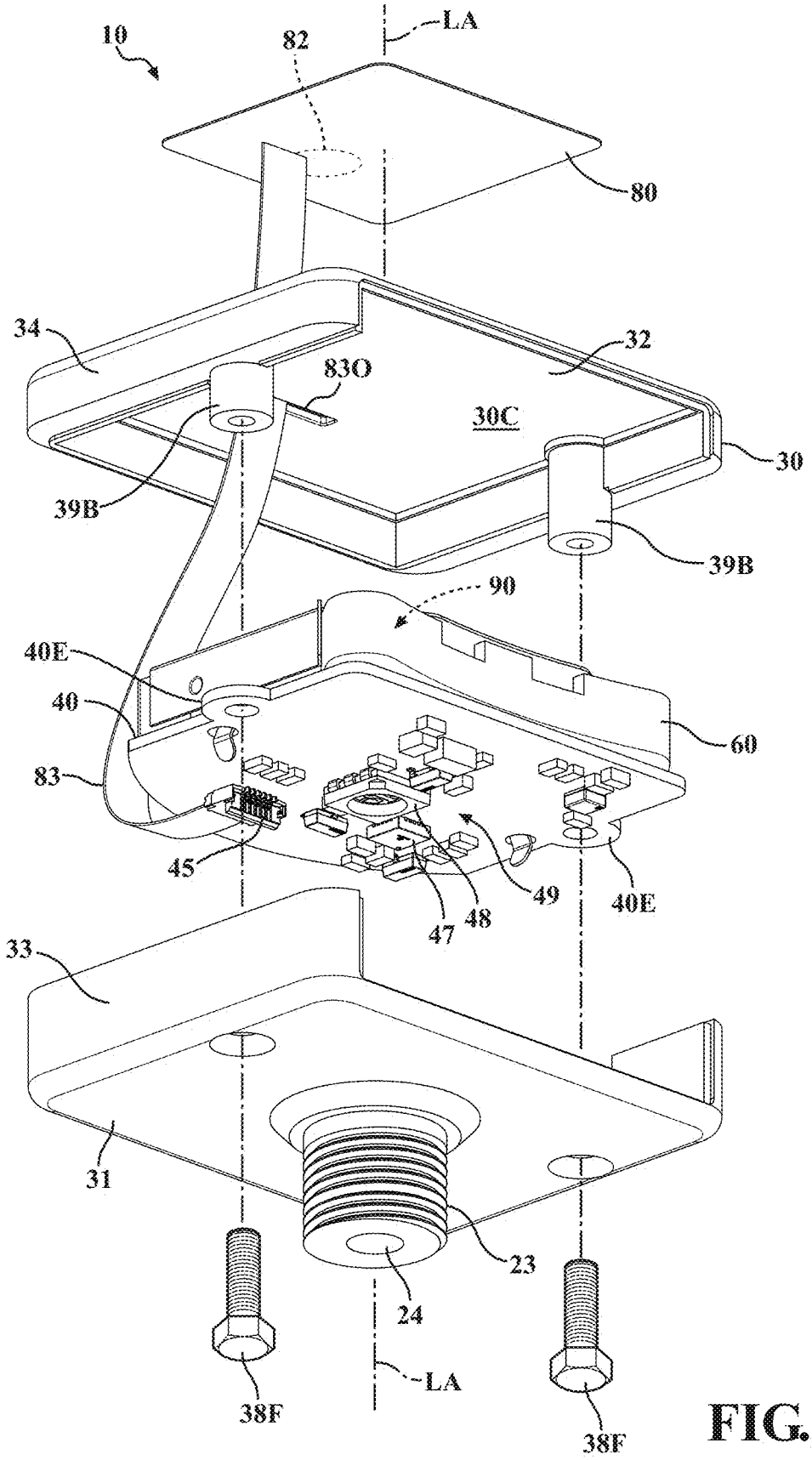
FIG. 5 is a vertically exploded lower view of the bow sight light.

The circuit board 40 of the bow sight light 10 as shown in FIGS. 4 and 5, can be mounted in the housing 30 within the internal compartment 30C. Optionally, the circuit board can be disposed between the proximal wall 31 and the distal wall 32. Further optionally, the circuit board can be disposed adjacent the battery tray receiver and the proximal wall 31 and shaft 23. The circuit board 40 further optionally can be disposed between the battery 90 and battery tray 60, and the proximal wall 31 and/or the shaft 23. In other applications, the circuit board 40 can be disposed above the battery tray receiver and/or the battery and its tray. The circuit board 40 can include ears 40E that define holes through which the fasteners 38F can be disposed to secure the circuit board in place. The battery tray receiver 50 can be welded, fixed or otherwise securely fastened to the circuit board and in electrical communication with its control system 49. This can enable the components of the battery tray receiver 50, which again can include the arms 55 that form terminals for the battery to provide electrical transmission from the battery through the battery tray receiver 50 to the components of the circuit board 40 and the control system 49.

Figure 6:
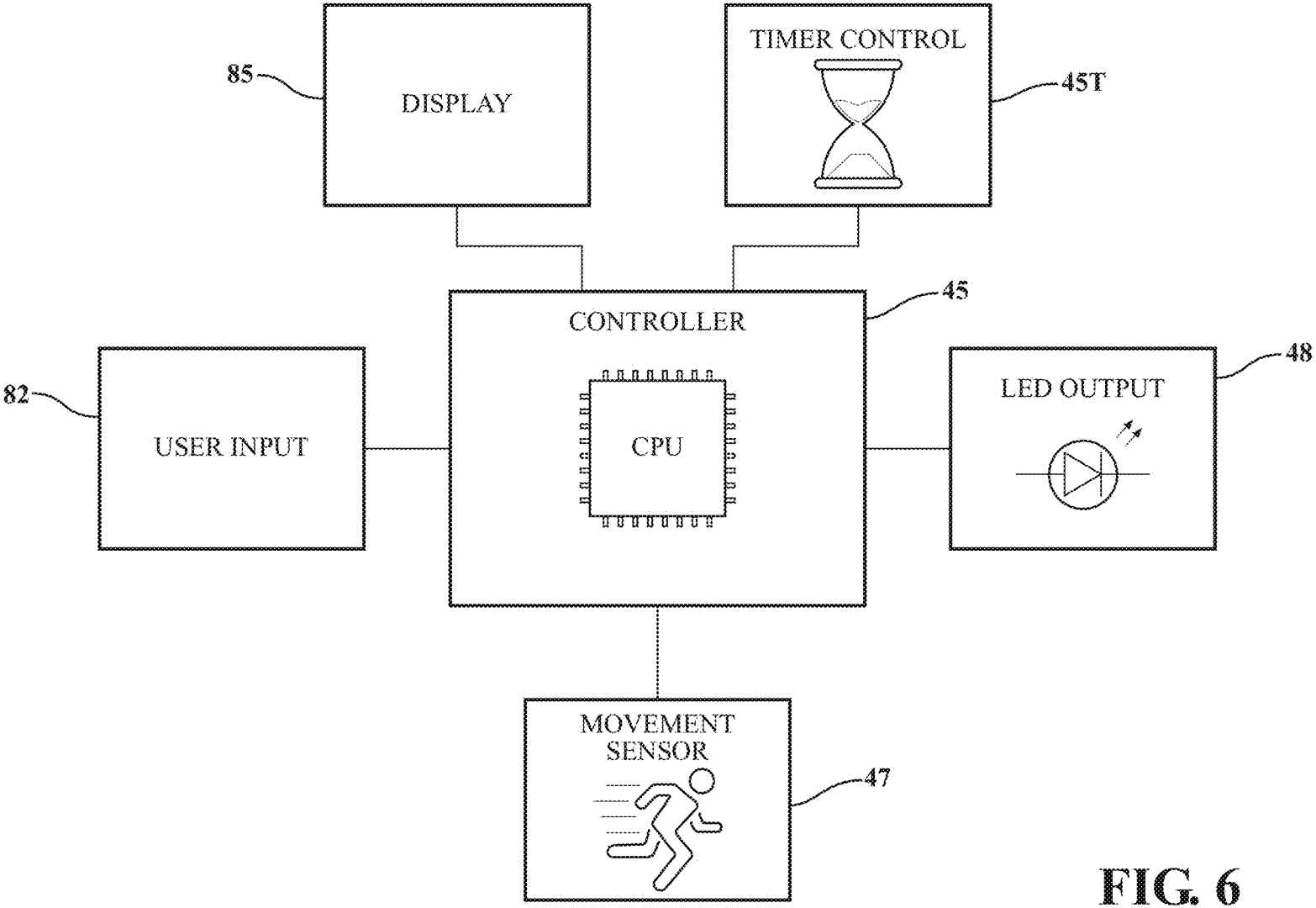
FIG. 6 is a schematic of the controller, movement sensor, time control and light source in the system of the bow sight light.

With reference to FIG. 6, the control system 49 can include a controller 45 which can include a processor, CPU or other computing element that can otherwise control the various functions of the control system 49. A light source 48 can be joined with the circuit board and electrically coupled to other elements thereon. This light source 48 can be in the form of an LED, an OLED, an SMD LED, a compact fluorescent lamp, or other small light source capable of fitting in the confines of the primary compartment 30C of the housing 30. The light source can project illumination L of varying colors, hues, and brightness. In some cases, the light source can project blue light in the wavelength range of 300 nanometers to 500 nanometers, inclusive, or green light in the wavelength range of 495 nanometers to 570 nanometers, inclusive. Of course, other wavelengths can be selected depending on the application. The light source 48 can be aligned with the longitudinal axis LA and the light bore 24 extending through the shaft 23 that connects the housing to bow sight. The LED can be in electrical communication and controlled by the controller 45 to turn on and turn off that light source 48 in a controlled manner based on preprogrammed parameters stored or otherwise carried out by the controller 45.

The controller 45 can be in communication with a movement sensor 47 and can include a timer control 45T as shown in FIG. 6. The movement sensor can be an accelerometer, a gyroscope, a magnetometer, a tilt sensor, a reed switch, a contact sensor, a force sensor or other types of sensors. When the movement sensor senses movement, a signal can be sent to or otherwise received by the controller 45 and processed as described below. The timer control unit 45T can be any type of timer that can be turned on or off by the controller to start a timing sequence as described below. All of these components can be mounted on the circuit board in a variety of different manners and further coupled to other components such as transistors, resistors, capacitors, circuits and other elements depending on the application.

The controller 45 as well as other components and the circuit board 40 can be disposed adjacent the coin battery tray and/or the tray receiver. On a high level, the controller 45 can be configured and/or programmed to automatically power the light source 47 with electricity from the battery 90 when the movement sensor 47 detects movement. Such movement might be detected when the bow sight light 10, the bow sight 100 and/or the bow 105 is moved by a user. This might occur when the user picks up the bow and readies to shoot the bow at a target or game. As shown in FIG. 2, when the light source 48 is automatically powered by the controller, the light L projected by the light source 48 projects through the light bore 24, through the shaft 23 and toward the light fibers 105A, 105B, 105C which can be disposed in the base 103 or generally aligned with the bore. As a result, the ends of the light fibers can illuminate further with illumination L2 to provide aiming points or sight indicia for the user to use when shooting the bow.

The controller 45 optionally can be programmed and/or configured to turn off the light source 47 after a predetermined amount of time passes after the light source is initially automatically powered by the controller or otherwise powered by input through the manual input 82. The controller can be programmed via the display 80 to set the predetermined amount of time. For example, a user can use the manual input 82 to input a certain time increment, for example 1 minute, 2 minutes, 3 minutes, 4 minutes, 5 minutes, or other amounts of time after which to turn off the light source and cease transmission of electricity or voltage from the battery 90 to the light source 47. The timer control 45T can start counting or measuring the time passage after the movement sensor 47 senses motion and/or the controller 45 starts to power the light source 48. After the first predetermined amount of time passes, the controller can put the bow sight light in an inactivity sleep mode in which the light is depowered after the last movement is sensed. If no more motion is sensed during that first predetermined amount of time, the controller can put the system in a deep sleep mode also referred to as a hard off mode or hard sleep mode. The timer control also can measure the passage of a second predetermined amount of time that can be preset by the user through the manual input 82. The second predetermined amount of time can be set increments optionally longer than the increments of time mentioned above for the inactivity sleep mode. For example, the second predetermined amount of time can be set at 1 hour, 2 hours, 3 hours, 4 hours, 5 hours or other increments which like the first predetermined amount of time can be displayed on the display portion 85 to provide feedback to the user while setting the controller and the first predetermined amount of time and second predetermined amount of time. The controller can be programed to put the control system 49 into a deep sleep mode after the second predetermined amount of time is sensed or measured by the timer control 45T. At that time, the system can completely shut down and has to be restarted or activated by the user engaging the manual input 82 to start the system again.

To turn on the bow sight light 10 and activate the controller 45, the user can engage the manual input 82. This can send a signal to the controller 45 which optionally can illuminate the light source 47, via voltage from the battery 90. This can be in a manual mode in which the user effectively turns on the bow sight light via initial engagement of the manual input 82. After a first predetermined amount of time, if the controller does not receive further input from the movement sensor, the timer controller can communicate with the controller 45 and the controller can turn off the light source 48 ceasing illumination of the sight elements and/or the light fibers associated with them. The controller 45 can constantly monitor the output of the movement sensor 47. Upon movement of the bow and thus the movement sensor 47, the sensor can produce positive or negative signal, for example ±3 volts. The controller can activate the light source 48 and it can create the illumination L. The controller can simultaneously start the timer control 45T to monitor the first predetermined amount of time and/or the second predetermined amount of time. During the first predetermined amount of time, the controller can keep power to the light source so the light source 48 is illuminated. If the bow sight light 10 remains motionless through that first predetermined amount of time, the motion sensor will cease producing the signal then the controller will turn off the light source 48 to cease the illumination.

The timer control 45T optionally can start measuring the time that the light 10 is motionless. When the time that the movement sensor remains motionless exceeds the first preferred amount of time, such as 5 minutes, the controller turns the light source off and can enter an inactivity sleep mode. If the movement sensor was moved before the controller entered the inactivity sleep mode, the controller keeps power to the light source as it continues to monitor the output of the movement sensor. If the movement sensor was not moved, and the controller entered the inactivity sleep mode, the controller remains in the inactivity mode with the light source off. If the output of the movement sensor becomes positive, for example, when the bow is moved, the controller immediately and automatically without further input from the user, will turn on the light source and exit the inactivity sleep mode, again while still monitoring the output of the movement sensor. The timer control also will start monitoring time passage.

If the timer control exceeds the second predetermined amount of time while the bow is motionless, and the movement sensor does not generate output to the controller, the controller will turn off the entire system and enter a deep sleep mode. The movement sensor will stop detecting movement and have no more output to the controller and the controller will cease operation until the user engages the manual input 82 to restart the system. It will be appreciated that the controller can be programmed in a variety of different manners and the inactivity sleep mode and deep sleep mode can be modified depending on the application.

Further optionally, the controller 45 can process different input from a user via the manual input 82. For example, the manual input 82 can be configured so that the system is turned on upon the user pushing or engaging the manual input 82. The manual input can be configured so that the system turns completely off, entering a deep sleep mode, when the manual input 82 is pushed for more than 5 seconds. The manual input can be configured to control the controller to alter the brightness of the display, the display of alphanumeric or other indicia on the display, such as battery life, a timer or clock, or some other output of the display portion 85 based on different sequences of engagement with the manual input 82. In some cases, the manual input can be a one button toggle split in two or a two button toggle that a user can operate to go through different settings of the light and illumination.

The illumination L projected can be of varying colors, brightnesses and other properties. Optionally, a user can input a brightness setting to the controller 45 via the manual input 82 as described below. In some cases, there can be brightness settings displayed on the display in alphanumeric characters. While there can be any number of brightness settings, the current embodiment can include five to eight brightness settings that can be selected by the user toggling through those settings with the manual input that runs the controller to adjust illumination L brightness.

Although the different elements and assemblies of the embodiments are described herein as having certain functional characteristics, each element and/or its relation to other elements can be depicted or oriented in a variety of different aesthetic configurations, which support the ornamental and aesthetic aspects of the same. Simply because an apparatus, element or assembly of one or more of the elements is described herein as having a function, does not mean its orientation, layout or configuration is not purely aesthetic and ornamental in nature.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

Reference throughout this specification to "a current embodiment" or "an embodiment" or "alternative embodiment" means that a particular feature, structure, or characteristic described in connection with the embodiment is included in at least one embodiment herein. Accordingly, the appearance of the phrases "in one embodiment" or "in an embodiment" or "in an alternative embodiment" in various places throughout this specification are not necessarily all referring to the same embodiment. Additionally, the particular features, structures, or characteristics of one embodiment are contemplated for proper and full combination in any suitable manner in one or more other embodiments, which is fully contemplated herein. Further, features, structures, or characteristics of one embodiment or multiple embodiments are readily and completely mixed and matched with any features, structures, or characteristics of any other embodiment or multiple embodiments in varying combinations and permutations.

What is claimed is:

1. An archery bow sight light comprising:

a threaded shaft defining a light bore extending therethrough, the threaded shaft including a first end configured for placement in alignment with a plurality of light fibers extending to a sight pin of a bow sight, the first end being threaded to be received in a corresponding threaded hole of the bow sight, the shaft including a second end distal from the first end, the shaft including a longitudinal axis that extends centrally through the light bore;

a housing defining a primary compartment oriented along a plane with the longitudinal axis being orthogonal to the plane, the housing including a distal wall distal from the shaft with the longitudinal axis being orthogonal to the distal wall and a proximal wall joined with the second end of the shaft, the housing defining a battery access opening laterally offset and distal from the light bore and longitudinal axis and located between the distal wall and the proximal wall;

a closure moveably joined with the housing and operable in a closed mode to cover the battery access opening and an open mode to provide access to the battery access opening;

a coin battery tray disposed in the primary compartment, the coin battery tray sized to receive therein a coin battery having a diameter of 10 mm to 30 mm, inclusive, and a height of 1 mm to 8 mm, inclusive, the coin battery tray being operable in a locked mode in which the coin battery tray is fixed relative to the primary compartment and a removal mode in which the coin battery tray is configured to slidably move through the battery access opening parallel to the plane when the closure is in the open mode to provide access to a coin battery in the coin battery tray;

a controller in the housing adjacent the coin battery tray, the controller coupled to a light source which is configured to project light through the light bore, the controller in communication with a movement sensor, the controller configured to automatically power the light source when a signal is provided from the movement sensor indicating that the bow sight has moved, the controller configured to turn off the light source after a predetermined amount of time passes after the light source is powered.

2. The archery bow sight light of claim 1, wherein the controller is joined with a circuit board, wherein the circuit board is disposed between the battery tray and the proximal wall, wherein the circuit board is coupled to a user input.

3. The archery bow sight light of claim 2, wherein the user input is disposed on an exterior of the distal wall, wherein the user input is a manual input that is adjacent a display that displays at least one alphanumeric character.

4. The archery bow sight light of claim 3, comprising:

a battery tray receiver disposed in the housing in the primary compartment between the light source and the distal wall, wherein the battery tray receiver slidably receives the battery tray, wherein the battery tray receiver defines a battery tray receiver opening aligned with the battery access opening.

5. The archery bow sight light of claim 4, wherein the closure extends over the battery access opening and the battery tray receiver opening in the closed mode, wherein the closure is a panel hingedly joined with the housing and configured to swing over the battery access opening.

6. The archery bow sight light of claim 1 comprising:

a battery tray receiver fixed to the housing inside the primary compartment and defining a tray compartment configured to slidably receive the battery tray.

7. The archery bow sight light of claim 6, wherein the battery is installed in the battery tray, wherein the battery tray receiver includes an arm that contacts the battery installed in the tray to provide power to the light source.

8. The archery bow sight light of claim 1, wherein the proximal wall is a plate extending laterally outward away from the shaft and the longitudinal axis, wherein the controller is disposed on a circuit board.

9. The archery bow sight light of claim 8, wherein the circuit board is fastened with a fastener to the housing inside the primary compartment.

10. The archery bow sight light of claim 1, wherein the housing includes a display, wherein the display is in communication with the controller, wherein the display includes a user input by which a user can input control parameters for operation of at least one of the controller, the light source and the display, wherein the display is intersected by the longitudinal axis of the shaft.

11. An archery bow sight light comprising:

a threaded shaft defining a light bore extending therethrough and including a longitudinal axis that extends centrally through the light bore;

a housing defining a primary compartment and including a proximal wall joined with the threaded shaft, the housing defining a battery access opening laterally offset and distal from the light bore and longitudinal axis;

a closure moveably joined with the housing and operable in a closed mode to cover the battery access opening and an open mode to provide access to the battery access opening;

a coin battery tray disposed in the primary compartment, the coin battery tray sized to receive therein a coin battery having a diameter of 10 mm to 30 mm, inclusive and a height of 1 mm to 8 mm, inclusive, the coin battery tray laying in a plane to which the longitudinal axis is orthogonal, the coin battery tray being operable in a locked mode in which the coin battery tray is fixed relative to the primary compartment and a removal mode in which the coin battery tray is configured to slidably move through the battery access opening parallel to the plane when the closure is in the open mode to provide access to a coin battery in the coin battery tray;

a light source disposed in the primary compartment between the coin battery tray and the light bore, the light source able to be powered by the coin battery when coupled thereto, the light source configured to project light through the light bore.

12. The archery bow sight light of claim 11 comprising:

a controller adjacent the coin battery tray, the controller in communication with a movement sensor, the controller configured to automatically power the light source when a signal is provided from the movement sensor indicating that the bow sight has moved, the controller configured to turn off the light source after a predetermined amount of time passes after the light source is powered.

13. The archery bow sight light of claim 12, comprising:

an input control joined with the controller, the input joined with a wall of the housing, the housing defining a hole distal from the battery access opening, a flex cord coupling the input control with the controller, the flex cord extending through the hole.

14. The archery bow sight light of claim 13, comprising:

a battery tray receiver inside the housing and defining a tray compartment configured to slidably receive the battery tray, wherein the battery is installed in the battery tray, wherein the battery tray receiver includes an arm that contacts the battery installed in the tray to provide power to the light source.

15. The archery bow sight light of claim 11, wherein the housing includes a proximal wall in the form of a plate that extends outward from the threaded shaft, the plate extending to the battery access opening, wherein the battery access opening is defined between opposing sidewalls of the housing that are perpendicular to the plate.

16. The archery bow sight light of claim 15, wherein the housing includes a distal wall joined with the opposing sidewalls, wherein the distal wall is perpendicular to the opposing sidewalls, wherein the light source is joined with a printed circuit board that is parallel to the plane and to the plate inside the primary compartment.

17. The archery bow sight light of claim 16, comprising:

a controller adjacent the coin battery tray, wherein the controller is operable in a sleep mode in which the controller turns off the light source after a predetermined amount of time past a time when the light source is powered to project light through the light bore.

18. An archery bow sight light comprising:

a threaded shaft defining a light bore extending therethrough and including a longitudinal axis that extends centrally through the light bore;

a housing defining a primary compartment and including a proximal wall joined with the threaded shaft, the housing defining a battery access opening laterally offset and distal from the light bore and longitudinal axis such that the longitudinal axis does not intersect the battery access opening;

a coin battery tray disposed in the primary compartment, the coin battery tray sized to receive therein a coin battery having a diameter of 10 mm to 30 mm, inclusive, and a height of 1 mm to 8 mm, inclusive, the coin battery tray laying in a plane to which the longitudinal axis is orthogonal, the coin battery tray being configured to slidably move through the battery access opening parallel to the plane to provide access to a coin battery in the coin battery tray; and a light source disposed in the primary compartment between the coin battery tray and the light bore, the light source able to be powered by the coin battery when coupled thereto, the light source configured to project light through the light bore.

19. The archery bow sight light of claim 18, comprising:

a controller adjacent the coin battery tray, the controller in communication with a movement sensor, the controller configured to automatically power the light source when a signal is provided from the movement sensor indicating that the bow sight has moved, the controller configured to turn off the light source after a predetermined amount of time passes after the light source is powered.

20. The archery bow sight light of claim 18, comprising:

a battery tray receiver inside the housing defining a tray compartment configured to slidably receive the battery tray, wherein the battery is installed in the battery tray, wherein the battery tray receiver includes an arm that contacts the battery installed in the tray to provide power to the light source.

* * * * *